US005597117A

United States Patent [19]

Watanabe et al.

[11] Patent Number: 5,597,117

[45] Date of Patent: Jan. 28, 1997

[54] EXPANSION VALVE WITH NOISE SUPPRESSION

[75] Inventors: Kazuhiko Watanabe, Kanagawa-ken; Kota Shinohara, Tokyo; Tetsurou Ikoma, Kanagawa-ken, all of Japan

[73] Assignee: Fujikoki MFG. Co., Ltd., Tokyo, Japan

[21] Appl. No.: 423,143

[22] Filed: Apr. 17, 1995

[30] Foreign Application Priority Data

Nov. 17, 1994 [JP] Japan ..... 6-283483

[51] Int. Cl.[6] ..... F25B 41/09

[52] U.S. Cl. ..... 236/92 B; 62/511

[58] Field of Search ..... 236/92 B, 99 R; 62/511, 528, 504

[56] References Cited

U.S. PATENT DOCUMENTS 2,327,542 8/1943 Matteson ..... 236/92 B 3,842,616 10/1974 Orbesen ..... 236/92 B 4,542,852 9/1985 Orth et al. ..... 236/92 B

*Primary Examiner*—John M. Sollecito

*Attorney, Agent, or Firm*—Foley & Lardner

[57] ABSTRACT

An expansion valve used in an air conditioner having a passage for a liquid-phase refrigerant sent from a reservoir to a valve body, and a passage for a vapor-phase refrigerant after passing an evaporator 8. The refrigerant passage includes a valve chamber to control the amount of the refrigerant passing through the valve by means of a member configured to engage with a valve seat. The valve member is operated by a valve driving rod which can move in the axial direction in response to the temperature and pressure of the vapor-phase refrigerant. An orifice is interposed between a liquid-phase refrigerant inlet port and the valve chamber to decrease that bubbles contained in the refrigerant entering into the valve chamber by means of its throttling hole. Also the passage from the valve chamber to the valve seat is tapered to prevent collapse of bubbles.

15 Claims, 4 Drawing Sheets

EXPANSION VALVE WITH NOISE SUPPRESSION

BACKGROUND OF THE INVENTION

1. Field of the Invention

This invention relates to a thermostatic expansion valve in a refrigerant system for air conditioners of cars, and in particular, to an improvement in the internal structure of such thermostatic expansion valves of a type having a built-in thermosensitive mechanism.

2. Description of the Prior Art

FIG. 3 is an explanatory view showing an arrangement of refrigerating cycle of an air conditioner. The refrigerating cycle generally labelled 1 includes a compressor 4 driven by a motor 2, or the like, a condenser 5, a reservoir 6 containing a refrigerant condensed and liquidized by the condenser, a expansion valve 10 controlling the amount of the liquid refrigerant to pass through, and an evaporator 8.

The expansion valve 10 has a thermal sensor 10*a* which detects the temperature of the refrigerant near the exit of the evaporator 8, and a pipe 10*b* for equalizing a diaphragm the expansion valve has, such that these values are fed back to the expansion valve 10 to adjust the rate of the opening.

Numeral 11 denotes a pipe system of the refrigerating system, and 12 denotes a fan for introducing external air into the condenser 5.

Air conditioners for use in cars, for example, generally include a thermostatic expansion valve having a built-in thermosensitive mechanism in order to save its mounting space or to omit wiring.

FIG. 4 is a view showing a general arrangement of an existing expansion valve.

A valve housing 30 of the thermostatic expansion valve defines first and second passages 32 and 34, vertically isolated from each other. The first passage 32 is interposed in a part of the refrigerant pipe system 11, extending from the refrigerant outlet of the condenser 5 via the reservoir 6 toward the refrigerant inlet of the evaporator 8. The second passage is interposed in a part of the refrigerant pipe system 11, extending from the refrigerant outlet of the evaporator 8 toward the refrigerant inlet of the compressor 4.

The first passage 32 includes a valve hole 32*a* for adiabatically expanding the liquid-phase refrigerant supplied from the refrigerant outlet of the reservoir 6. The center line of the valve hole 32*a* extends in the length direction of the valve housing 30. The valve hole 32*a* defines a valve seat at its inlet, which can be seated by a valve member 32*b* energized by a biasing means 32*c* such as compression coil spring.

The first passage 32, to which the liquid-phase refrigerant is supplied from the reservoir 6, behaves as the passage of the liquid-phase refrigerant, and includes an inlet port 321 and a valve chamber 35 continuous from the inlet port 321. The valve chamber 35 is a chamber concentrically aligned with the valve hole 32*a* and sealed at the bottom by a plug 37.

Mounted at the top end of the valve housing 30 is a valve driving unit 36 for driving the valve member 32*b*. The valve driving unit 36 has a pressure-operating housing 36*d* which defines an interior hollow partitioned by a diaphragm 36*a* into two upper and lower pressure-operating chambers, 36*b* and 36*c*.

The lower pressure-operating chamber 35*c* in the pressure-operating housing 36*d* communicates with the second passage 34 via an equalizing opening 36*e* which is concentric with the valve hole 32*a*.

Introduced into the second passage 34 is the vapor-phase refrigerator from the refrigerant outlet of the evaporator 8. Thus the second passage 34 behaves as a passage for vapor-phase refrigerant to apply the pressure of the vapor-phase refrigerant to the lower pressure-operating chamber 36*c* via the equalizing opening 36*e*.

Concentrically disposed in and beyond the equalizing opening 36*e* is a valve driving rod 36*f* extending from the lower surface of the diaphragm 36*a* to the valve hole 32*a* of the first passage 32. The valve driving rod 36*f* is supported for vertical slidable movements by an inner surface of the lower pressure-operating chamber 36*c* of the pressure-operating housing 36*d* and by a partition wall of the valve housing 30 separating the first passage 32 from the second passage 34, and its lower end is fixed to the valve member 32*b*. The valve driving rod 36*f* has a sealing member 36*g* on its outer circumferential surface of its part located in the partition wall in order to prevent the refrigerant from entering from the first passage 32 to the second passage 34, and vice versa.

The upper pressure-operating chamber 36*b* of the pressure-operating housing 36*d* is filled with a known fluid for driving the diaphragm. The vapor-phase refrigerant introduced into the second passage 34 from the evaporator 8 transmits its heat to the diaphragm-driving fluid via the valve driving rod 36*f* exposed to the vapor-phase refrigerator in the second passage 34 and the equalizing opening 36*e*.

The diaphragm-driving fluid in the upper pressure-operating chamber 36*b* is changed to a gaseous phase in response to the transmitted heat, and applies a pressure onto the upper surface of the diaphragm 36*a*. The diaphragm 36*a* is displaced vertically by a difference between the pressure of the diaphragm driving gas applied to the upper surface of the diaphragm 36*a* and the pressure applied to the lower surface of the diaphragm 36*a*.

The vertical displacement of the central portion of the diaphragm 36*a* causes the valve driving rod 36*f* to move vertically to bring the valve member 32*b* to or away from the valve seat at the valve hole 32*a*. As a result, the flow amount of the refrigerant is controlled.

In expansion valves of this type, it is desirable that the refrigerant delivered from the reservoir 6 is all in the vapor phase. In some cases, however, the gaseous-phase refrigerant is mixed in the reservoir and sent to the inlet port 321 in a mixed vapor-and-liquid phase. The refrigerant including a part in the gaseous phase is liable to generate a noise when running through the inlet port 321, valve chamber and valve seat into the outlet passage.

OBJECT OF THE INVENTION

It is therefore an object of the invention to provided an expansion valve free from a noise caused by a gaseous-phase refrigerant mixed into a liquid-phase refrigerant in a reservoir.

SUMMARY OF THE INVENTION

According to the invention, there is provided an expansion valve having a valve housing defining a passage for a refrigerant to be reduced in pressure to run through in its liquid phase and a passage for the refrigerant to run through in its gaseous phase from an evaporator toward a compressor, a valve seat and a valve chamber interposed in the passage for the refrigerant in the liquid phase, and a valve driving rod having one end fixed to a diaphragm supported by the valve housing and the other end supporting a valve member, so that the passage for the refrigerant in the liquid phase is adjusted in cross-sectional area in response to the temperature and pressure of the refrigerant in the gaseous phase, comprising: an orifice having a throttling hole in the passage for the refrigerant in the liquid phase between an inlet port and the valve chamber.

The refrigerant substantially in the liquid phase sent from a reservoir may include bubbles. The orifice interposed in the passage for the refrigerant in the liquid phase prohibits the entrance of the bubbles into the valve chamber, and reduces the noise caused by collapse of the bubbles. The part of the passage extending from the valve chamber to the valve seat and continuously throttled by the tapered wall suppresses impulses from the bubbles, and hence prevents collapse of the bubbles.

DETAILED DESCRIPTION OF THE PREFERRED EMBODIMENTS

Figure 1:
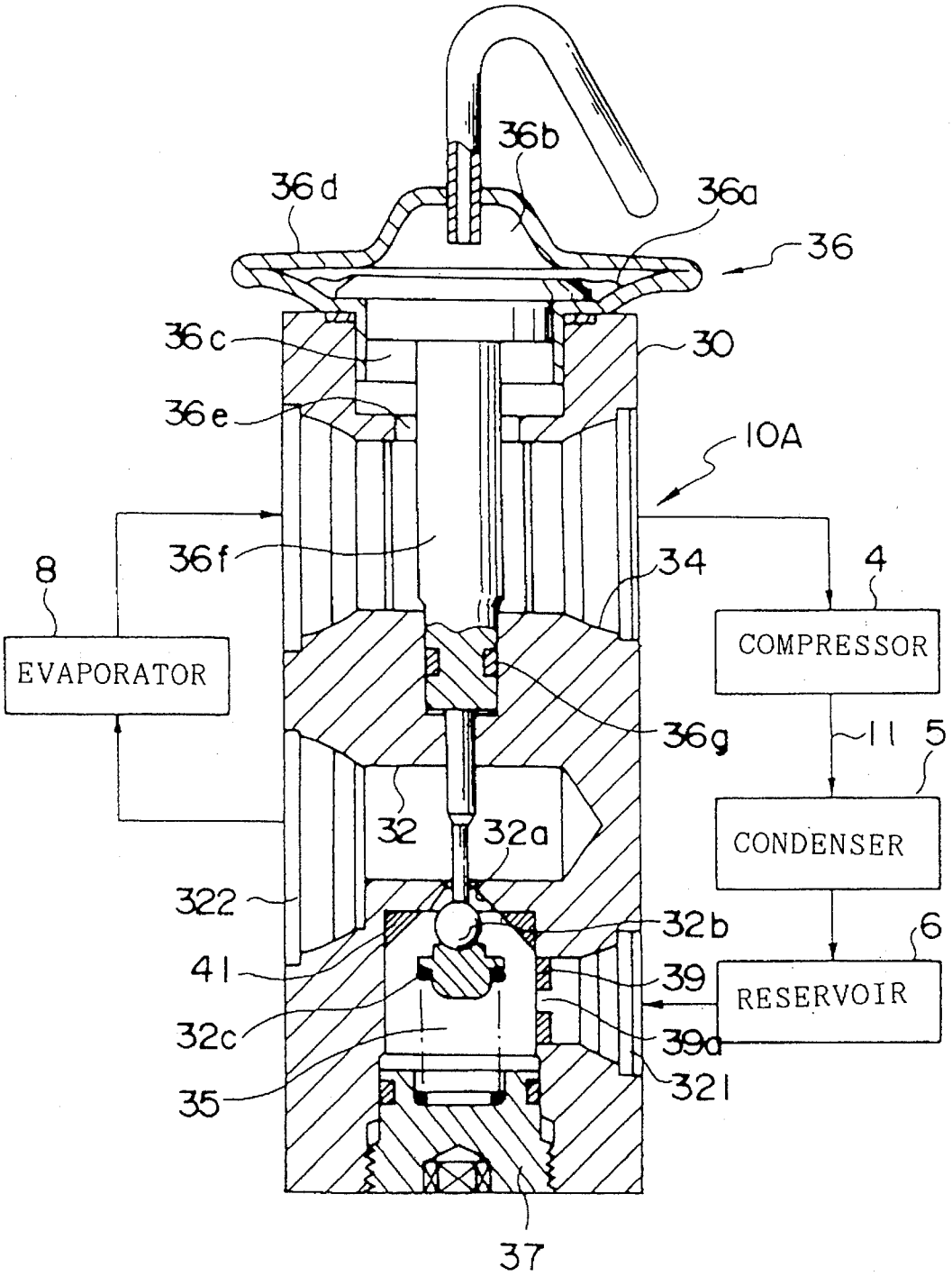
FIG. 1 is a central, longitudinal, cross-sectional view of a thermostatic expansion valve taken as an embodiment of the invention.
Figure 4:
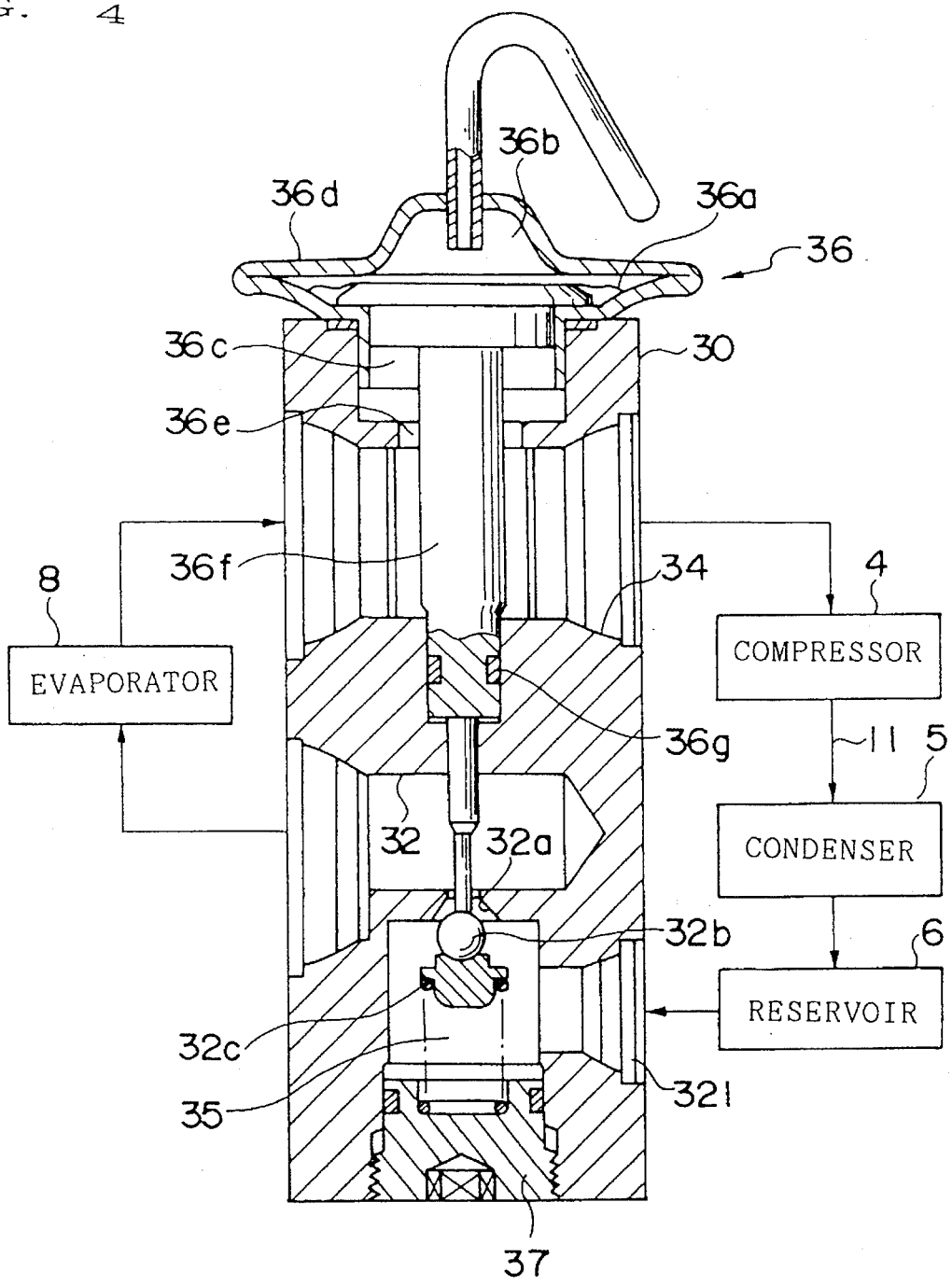
FIG. 4 is a central, longitudinal, cross-sectional view of an existing thermostatic expansion valve.

FIG. 1 is a cross-sectional view of an expansion valve according to the invention. Some parts or elements in FIG. 1 which are substantially identical to those of the existing expansion valve shown in FIG. 4 are labelled the same reference numerals, and their detailed explanation is omitted from the explanation given below.

The expansion valve according to the invention is generally labelled 10A. The expansion valve 10A has the first passage 32 defined by the valve housing 30 for a refrigerant in its liquid phase to pass through, and the second passage 34 for the refrigerant in its gaseous phase to pass through. The liquid-phase refrigerant passage 32 includes the inlet port 321, valve chamber 35, outlet port 322, and valve seat formed between the valve chamber 35 and the outlet port 322.

Vertical movement, either upward or downward, of the diaphragm 36*a* is transmitted by the valve driving rod 36*f* to the valve member 32*b*, and brings the valve member 32*b* to or away from the valve seat at the valve hole 32*a* so as to adjust the area of the passage defined between the valve member 32*b* and the valve seat and to hence control the flow amount of the refrigerant.

in the expansion valve according to the invention, the liquid-phase refrigerant passage 32 includes an orifice 39 between the inlet port 321 and the valve chamber 35. The orifice 39 includes, at its center, a throttling hole 39*a* with the diameter of 2 to 3 mm, approximately.

The liquid-phase, highly-compressed refrigerant sent from the reservoir 8 is throttled by the throttling hole 39*a* of the orifice 39, which results in decreasing the amount of bubbles in the liquid-phase refrigerant that can pass through. As a result, collapse of the bubbles in the expansion valve decreases, and a noise caused thereby also decreases.

In the present invention, a part of the wall surface of the valve chamber 35 near the valve seat represents a tapered surface 41, which alleviates impulses of collision of bubbles against the wall surface.

The collision-alleviating function also contributes to reduction in collapsing noise of bubbles near the valve seat.

The liquid-phase refrigerant arriving at the outlet port 322 is sent to and vaporized by the evaporator 8 while absorbing a certain amount of heat for vaporization, and the resulting vapor-phase refrigerant runs through the second passage 34 and flows back to the compressor 4. The refrigerant, after being compressed by the compressor 4, is liquidized by the condenser 5, and returns to the reservoir 6.

Figure 2:
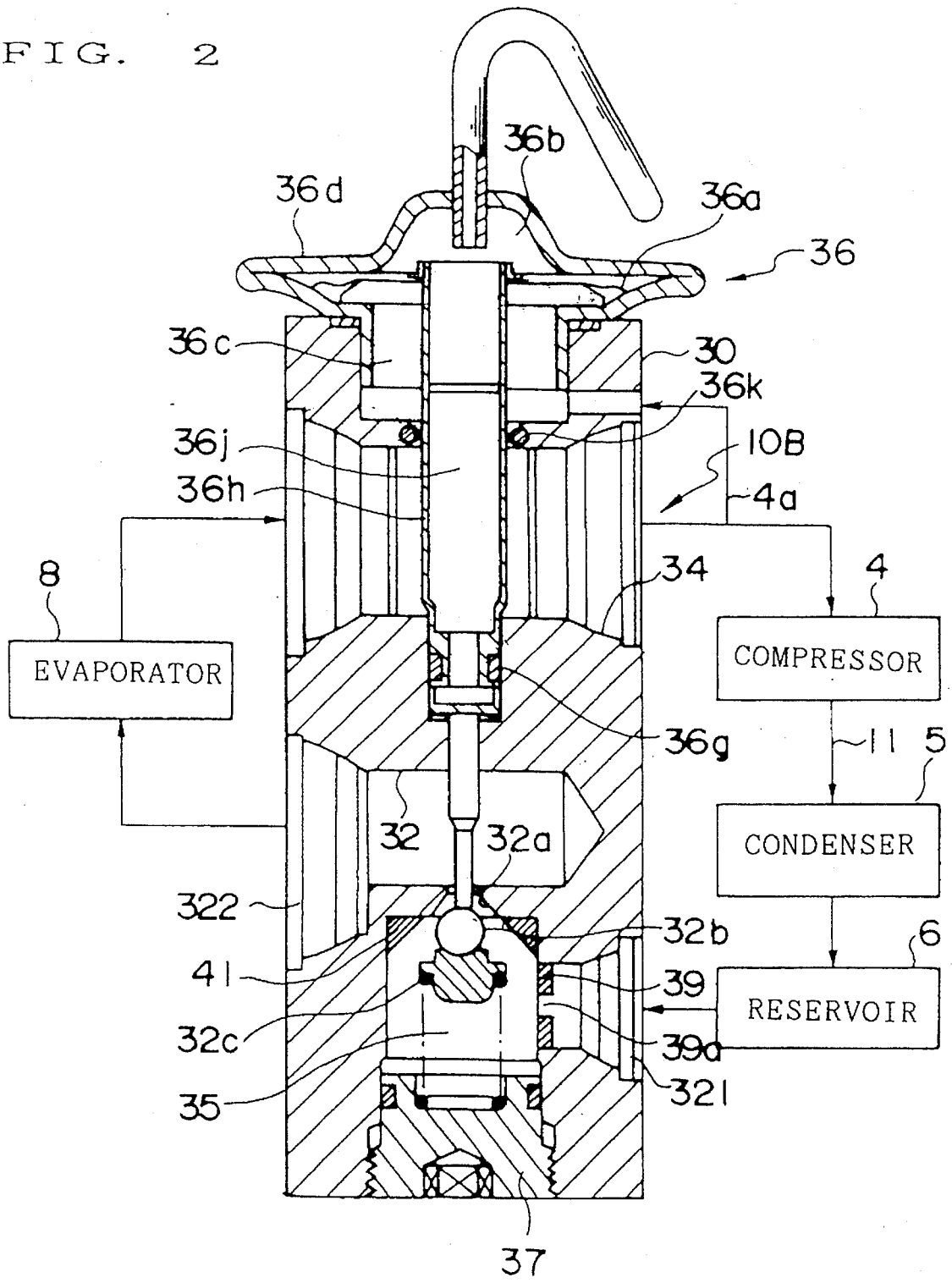
FIG. 2 is a central, longitudinal, cross-sectional view of a thermostatic expansion valve taken as another embodiment of the invention.
Figure 3:
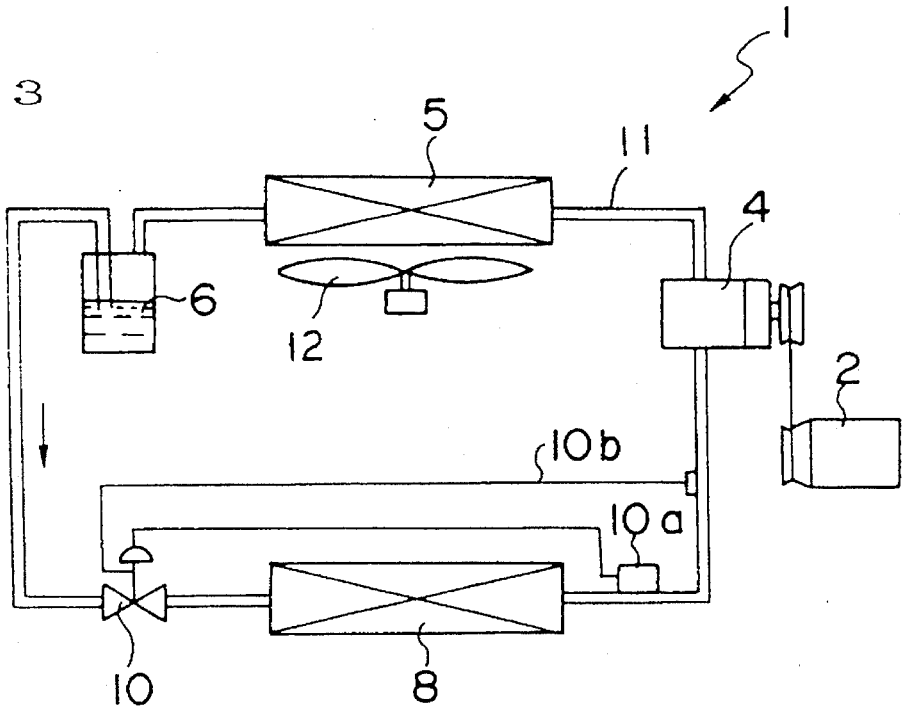
FIG. 3 is a diagram showing an existing refrigerant cycle.

FIG. 2 shows an expansion valve taken as a further embodiment of the invention.

The expansion valve, generally labelled 10B, has substantially the same basic structure, and its details is omitted from the explanation ,given below.

In this system, a valve driving rod 36*h* is a hollow member opening at its upper end into the pressure-operating chamber 36*b* above the diaphragm 36*a* and filled with, for example, activated carbon 36*j*. The valve driving rod 36*h* and the valve body 30 are sealed off from each other by a seal member 36*k*, and the vapor-phase refrigerant does not enter in the pressure-operating chamber 36*b* under the diaphragm, Instead, a pipe 4*a* ramified from the pipe between the vapor-phase refrigerant passage 34 and the compressor 4 is connected to a through hole formed in the valve body 30 to introduce the vapor-phase refrigerant into the pressure-operating chamber 36*c* of the diaphragm.

The carbon-filled portion 36*j* of the valve driving rod 36*h* penetrates the center of the vapor-phase passage 34 formed in the valve body 30. Therefore, the valve driving rod 36*h* contacts the vapor-phase refrigerant running therethrough, and detects the temperature of the refrigerant. The temperature of the refrigerant is absorbed by the activated carbon 36*j* in the valve driving rod 36*h*. The pressure in the first pressure chamber 36*b* is determined as a function of the surface temperature of the activated carbon, and this pressure governs the position of the valve driving rod 36*h* in the axial direction.

The expansion valve, here again, includes the orifice 39 provided in the flow path between the inlet port 321 of the liquid-phase refrigerant passage 32 and the valve chamber 35. The orifice 39 includes a throttling hole 39*a* with the diameter of 2 to 3 mm, approximately.

The highly-compressed, liquid-phase refrigerant sent from the reservoir 6 is throttled by the throttling hole, and the amount of bubbles in the liquid-phase refrigerant that can pass through the throttling hole is decreased. This results in decreasing collapse of bubbles in the expansion valve and in decreasing noise caused by such collapse.

Also the tapered wall surface 41 of the valve chamber near the valve seat behaves to alleviate impulses caused by collisions of bubbles onto the wall surface.

Alleviation of collisions of bubbles contributes to decreasing the collapsing noise of bubbles near the valve seat.

The liquid-phase refrigerant arriving at the outlet port 322 is sent to and evaporated by the evaporator 8 while absorbing a certain amount of heat for vaporization, and the resulting vapor-phase refrigerant runs through the second passage 34, and flows back to the compressor 4. The refrigerant, after compressed by the compressor 4, is liquidized by the condenser 5, and returns to the reservoir 6.

As described above, the expansion valve according to the invention for use in a refrigerating system of an air conditioner to be mounted in a car, or the like, particularly includes an orifice between the valve chamber for adjusting the flow amount of a highly-compressed liquid-phase refrigerant and the inlet port of the liquid-phase refrigerant, so as to throttle the flow of the liquid-phase refrigerant by using the throttling hole of the orifice. When the liquid-phase refrigerant passes through the throttling hole, most of bubbles contained in the liquid-phase refrigerant are prohibited to pass through the throttling hole. As a result, bubbles that can enter into the valve chamber decreases, and the noise caused by collapse of bubbles also decreases.

Further, due to the tapered surface provided in the pass continuous to the valve orifice in the valve chamber so as to gradually decrease the cross-sectional area toward the valve seat, impulses produced by collision of bubbles, if any, against the wall surface of the valve chamber are alleviated, and the collapsing noise of bubbles is also reduced.

What is claimed is:

1. An expansion valve comprising:

a valve housing defining a passage for a refrigerant to be reduced in pressure to run through in a liquid phase and a passage for said refrigerant to run through in a gaseous phase from an evaporator toward a compressor, a valve seat and a valve chamber interposed in said passage for the refrigerant in the liquid phase, a valve driving rod having one end fixed to a diaphragm supported by said valve housing and the other end supporting a valve member so that said passage for the refrigerant in the liquid phase is adjusted in cross-sectional area in response to the temperature and pressure of the refrigerant in the gaseous phase, and an orifice fixed in said passage for the refrigerant in the liquid phase between an inlet port and said valve chamber, said orifice having a throttling hole; wherein said passage for the refrigerant in the liquid phase and said throttling hole are configured to limit the amount of bubbles that pass through the orifice to thereby reduce noise during operation of the expansion valve.

2. An expansion valve comprising:

a valve housing defining a passage for a refrigerant to be reduced in pressure to run through in a liquid phase and a passage for said refrigerant to run through in a gaseous phase from an evaporator toward a compressor, a valve seat and a valve chamber interposed in said passage for the refrigerant in the liquid phase, a valve driving rod having one end fixed to a diaphragm supported by said valve housing and the other end supporting a valve member so that said passage for the refrigerant in the liquid phase is adjusted in cross-sectional area in response to the temperature and pressure of the refrigerant in the gaseous phase, and an orifice fixed in said passage for the refrigerant in the liquid phase between an inlet port and said valve chamber, said orifice having a throttling hole;

wherein a part of said passage for the refrigerant in the liquid phase extending from said valve chamber to said valve seat in cross-sectional area, wherein said tapered surface is configured to alleviate impulse produced from collisions of bubble in said refrigerant against a wall surface of said valve chamber; and where said orifice and said tapered surface thereby reduce noise during operation of the expansion valve.

3. The expansion valve according to claim 1, wherein said throttling hole is located adjacent said valve chamber.

4. The expansion valve according to claim 1, wherein said throttling hole is located at a center of said orifice.

5. The expansion valve according to claim 4, wherein said throttling hole has a diameter approximately in the range of 2 mm to 3 mm.

6. The expansion valve according to claim 1, wherein said valve driving rod comprises a hollow member.

7. The expansion valve according to claim 6, wherein said hollow member is filled with activated carbon.

8. The expansion valve according to claim 1, wherein a part of said passage for the refrigerant in the liquid phase extending from said valve chamber to said valve seat is defined by a tapered wall surface which gradually decreases in cross-sectional area.

9. The expansion valve according to claim 8, wherein said tapered surface alleviates imputes produced from collisions of bubble in said refrigerant against a wall surface of said valve chamber to thereby reduce noise during operation of the expansion valve.

10. The expansion valve according to claim 2, wherein said throttling hole is located adjacent said valve chamber.

11. The expansion valve according to claim 2, wherein said throttling hole is located at a center of said orifice.

12. The expansion valve according to claim 11, wherein said throttling hole has a diameter approximately in the range of 2 mm to 3 mm.

13. The expansion valve according to claim 2, wherein said throttling hole limits the amount of bubbles that pass through chamber to thereby reduce noise during operation of the expansion valve.

14. The expansion valve according to claim 2, wherein said valve driving rod comprises a hollow member.

15. The expansion valve according to claim 14, wherein said hollow member is filled with activated carbon.

* * * * *